US009690226B2

(12) United States Patent
Komatsu

(10) Patent No.: US 9,690,226 B2
(45) Date of Patent: Jun. 27, 2017

(54) IMAGE FORMING APPARATUS WITH CONTROLLED CHARGING VOLTAGE

(71) Applicant: CANON KABUSHIKI KAISHA, Tokyo (JP)

(72) Inventor: Isao Komatsu, Kashiwa-shi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/059,930

(22) Filed: Mar. 3, 2016

(65) Prior Publication Data

US 2016/0282745 A1 Sep. 29, 2016

(30) Foreign Application Priority Data

Mar. 23, 2015 (JP) ..... 2015-060167

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
See application file for complete search history.

(56) References Cited

U.S. PATENT DOCUMENTS 5,420,671 A * 5/1995 Kisu ..... G03G 15/0266 399/174
5,636,009 A * 6/1997 Honda ..... G03G 15/0266 399/176
2008/0124645 A1* 5/2008 Yamanaka ..... G03G 9/125 430/115
2009/0103936 A1* 4/2009 Tomiie ..... G03G 15/0216 399/50
2012/0269534 A1* 10/2012 Fuse ..... G03G 15/0266 399/89
2013/0195472 A1* 8/2013 Takami ..... G03G 15/0283 399/13

FOREIGN PATENT DOCUMENTS

| | | |
|---|---|---|
| JP | H07-044063 | 2/1995 |
| JP | 2001-201920 | 7/2001 |
| JP | 2012-247506 | 12/2012 |
| JP | 2013-142749 | 7/2013 |

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

A controller sets an AC voltage Vac, applies the voltage to a charging roller, and measures a DC component of a charging current flowing from the charging roller to a photosensitive drum. When it is determined that an absolute value of a measured value of the DC component in the charging current is lower than a prediction value, the controller sets an AC voltage Vac that differs from the AC voltage Vac set in step S4, and applies the voltage to the charging roller. Thereby, a charging current capable of performing sufficient charging can be flown to the photosensitive drum, and the photosensitive drum can thereby be charged to a desired surface potential.

17 Claims, 8 Drawing Sheets

| | NON-DISCHARGE RANGE (V) | | | DISCHARGE RANGE (V) | | |
|---|---|---|---|---|---|---|
| NORMAL TEMPARATURE | 1100 | 1200 | 1300 | 1600 | 1700 | 1800 |
| LOW TEMPARATURE | 1600 | 1700 | 1800 | 2100 | 2200 | 2300 |

FIG. 6

| TEMPERATURE (℃) | 0≦T<5 | 5≦T<10 | 10≦T<15 | 15≦T<20 | 20≦T<25 | 25≦T |
|---|---|---|---|---|---|---|
| AC VOLTAGE (V) | 2500 | 2300 | 2100 | 1900 | 1700 | 1500 |

IMAGE FORMING APPARATUS WITH CONTROLLED CHARGING VOLTAGE

BACKGROUND OF THE INVENTION

Field of the Invention

The present invention relates to electro-photographic image forming apparatuses, such as copiers, printers, facsimiles and multi-function printers.

Description of the Related Art

Hitherto, image forming apparatuses have adopted charging rollers, having a relatively low application voltage and those can be easily downsized, as primary charging units for charging photosensitive drums. A superimposed voltage (Vdc+Vac) having superimposed a DC voltage Vdc and an AC voltage Vac is applied from a charging high voltage power supply to the charging roller as charging voltage. When an AC voltage Vac (peak-to-peak voltage) that is equal to or higher than twice the amount of a discharge starting voltage Vth is applied to the charging roller, a surface potential Vd of the photosensitive drum is converged to a potential of the DC voltage Vdc. That is, the photosensitive drum is charged uniformly to a desired surface potential.

The discharge starting voltage Vth between the charging roller and the photosensitive drum may be fluctuated due to a material of the charging roller, a film thickness of a photosensitive layer of the photosensitive drum, a rotational speed (process speed) of the photosensitive drum, environments (such as temperature) within the apparatus body, and so on. If the AC voltage Vac applied to the charging roller remains unchanged when the discharge starting voltage Vth is fluctuated, the photosensitive drum may not be charged uniformly to the desired surface potential. An image forming apparatus where an appropriate AC voltage Vac is computed and applied to the charging roller, in order to uniformly charge the photosensitive drum to the desired surface potential even when the discharge starting voltage Vth is fluctuated, is known. For example, an apparatus that performs discharge current control by applying a plurality of AC voltages Vac sequentially, and based on the change of alternating currents Idc flowing to the charging roller, computing the AC voltage Vac to be applied to charge the photosensitive drum is proposed (Japanese Patent Application Laid-Open Publication No. 2001-201920).

Further, an image forming apparatus having a surface electrometer within an apparatus body, actually measuring a surface potential Vd of a photosensitive drum using the surface electrometer, and changing an AC voltage Vac based on the measured result is proposed (Japanese Patent Application Laid-Open Publication No. H07-44063).

As described above, the discharge starting voltage Vth is influenced by the temperature within the apparatus body, for example. That is, an electrical resistance of the charging roller differs between a case where the temperature within the apparatus body is a normal temperature (such as 15 through 25° C.) and a case where the temperature is a low temperature (such as 0 through 15° C.). Generally, in a low temperature environment, the resistance of the charging roller is increased and current flow is not likely to flow compared to normal temperature environment, so that the discharge starting voltage Vth is increased. Therefore, the apparatus detects the temperature within the apparatus body through a temperature sensor, and performs respective discharge current controls for normal temperature and for low temperature, based on the detected temperature. In the respective discharge current controls for normal temperature and for low temperature, the setting of voltages of the AC voltage Vac applied to the charging roller differ.

However, the temperature sensor is often provided at a location distant from the charging roller within the apparatus body, and the temperature detected by the temperature sensor does not always precisely reflect the temperature in the vicinity of the charging roller. That is, the temperature detected by the temperature sensor is merely the temperature measured at a specific location within the apparatus body, so that the detected temperature may not correspond to the temperature in the vicinity of the charging roller. In that case, even if discharge current control is performed, an AC voltage Vac double or lower the amount of discharge starting voltage Vth may be charged to the charging roller. As a result, the surface potential Vd of the photosensitive drum will not be converged to the potential of the DC voltage Vdc, and a fogging phenomenon may occur. It may be possible to adopt an apparatus having a surface electrometer with the aim to prevent the surface potential Vd of the photosensitive drum from not being converted to the potential of the DC voltage Vdc, but an apparatus equipped with a surface electrometer cannot easily be downsized, and related costs are expensive, so that it is not desirable to adopt such apparatus.

SUMMARY OF THE INVENTION

Further, the present invention provides an image forming apparatus including a rotatable image bearing member, a charging member disposed proximate or in contact with the image bearing member, the charging member charging the image bearing member by applying a voltage having superimposed an AC voltage and a DC voltage as charging voltage during an image forming operation of forming an image on the image bearing member, an image forming unit forming an image on the image bearing member being charged by the charging member, a direct current detection unit capable of detecting a direct current flowing from the charging member to the image bearing member when the charging voltage is applied to the charging member and a control unit capable of selectively executing a first mode of setting a voltage having superimposed a first AC voltage and the predetermined DC voltage as a charging voltage during an image forming operation, and a second mode of setting a voltage having superimposed a second AC voltage higher than the first AC voltage and the predetermined DC voltage as the charging voltage during the image forming operation, the control unit applying the voltage having superimposed the first AC voltage and the predetermined DC voltage to the charging member, and detecting a direct current flowing from the charging member to the image bearing member via the direct current detection unit during execution of the first mode, and if an absolute value of the detected direct current is lower than a predetermined value, switching the first mode to the second mode and executing the second mode.

Further features of the present invention will become apparent from the following description of exemplary embodiments with reference to the attached drawings.

BRIEF DESCRIPTION OF THE DRAWINGS

FIG. 6 is a view illustrating a table having associated AC voltage and temperature.

DESCRIPTION OF THE EMBODIMENTS

First Embodiment

Now, a first embodiment according to the present invention will be described in detail. At first, an image forming apparatus according to the first embodiment will be described with reference to FIG. 1.

<Image Forming Apparatus>

Figure 1:
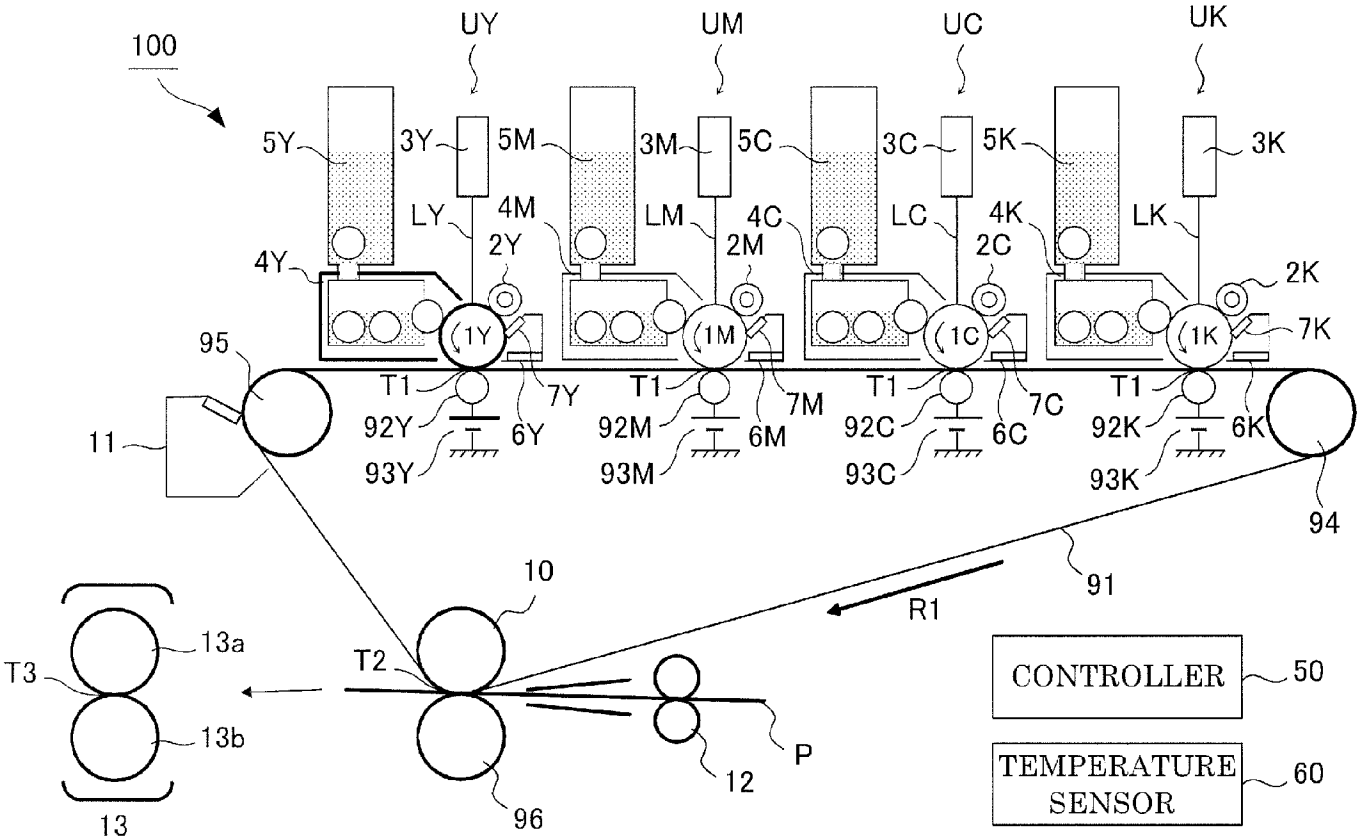
FIG. 1 is a schematic view showing a configuration of an image forming apparatus according to a first embodiment of the present invention.

An image forming apparatus 100 illustrated in FIG. 1 is a tandem intermediate transfer type full-color printer having image forming units UY, UM, UC and UK of yellow, magenta, cyan and black arranged along an intermediate transfer belt 91. In the present embodiment, these image forming units UY, UM, UC and UK are configured as process cartridges that can be attached to/detached from the apparatus body.

In the image forming unit UY, a yellow toner image is formed on a photosensitive drum 1Y, i.e., image bearing member, and primarily transferred to the intermediate transfer belt 91. In the image forming unit UM, a magenta toner image is formed on a photosensitive drum 1M, and the image is primarily transferred to be superposed on the yellow toner image formed on the intermediate transfer belt 91. In the image forming units UC and UK, a cyan toner image and a black toner image are respectively formed on photosensitive drums 1C and 1K, which are primarily transferred to be sequentially superposed on the intermediate transfer belt 91. The four-color toner images primarily transferred to the intermediate transfer belt 91 are conveyed to a secondary transfer unit T2, and collectively secondarily transferred to a recording material P (paper, OHP sheet and other sheet material).

The image forming units UY, UM, UC and UK are configured similarly, except for the colors of the toners, which are yellow, magenta, cyan and black, used in respective developing units 4Y, 4M, 4C and 4K. The following description describes a yellow image forming unit UY as an example, and the same description applies for the other image forming units UM, UC and UK by replacing the symbol Y on the end of reference numbers with M, C or K.

The image forming unit UY is formed by arranging a charging roller 2Y (primary charging unit), an exposing unit 3Y, a developing unit 4Y, a primary transfer roller 92Y, a destaticizing exposure unit 6Y and a drum cleaning unit 7Y around the photosensitive drum 1Y. The photosensitive drum 1Y, i.e., image bearing member, is a drum-shaped electrophotographic photoreceptor having a photosensitive layer formed on an outer circumferential surface of an aluminum cylinder, disposed rotatably on the apparatus body. The photosensitive drum 1Y is rotated in a counter-clockwise direction in FIG. 1 at a rotational speed (process speed) of 250 mm/s, for example, by a photosensitive drum driving motor 19Y (refer to FIG. 3 described later).

The charging roller 2Y, i.e., charging member, charges the surface of the photosensitive drum 1Y to a uniform dark potential having negative polarity. The destaticizing exposure unit 6Y, i.e., destaticizing portion, initializes the charged state of the photosensitive drum 1Y prior to having the photosensitive drum 1Y charged by the charging roller 2Y. That is, the destaticizing exposure unit 6Y destaticizes the photosensitive drum 1Y by exposing the photosensitive drum 1Y after primary transfer to UV light, for example. The destaticizing exposure unit 6Y is disposed downstream, in the direction of rotation of the photosensitive drum 1Y, of a primary transfer portion T1, and at least upstream, in the direction of rotation, of the charging roller 2Y. A toner image is formed on the photosensitive drum 1Y, charged by the destaticizing exposure unit 6Y, by the exposing unit 3Y and the developing unit 4Y, i.e., image forming unit. That is, the exposing unit 3Y and the developing unit 4Y form an image on the photosensitive drum 1Y charged by the charging roller 2Y.

The exposing unit 3Y generates laser beams from a laser emitter by performing ON-OFF modulation to a scanned image data having expanded color separation images of respective colors, scans the laser beams using a rotation mirror, irradiates the beams to the charged photosensitive drum 1Y, and forms an electrostatic latent image on the photosensitive drum 1Y. The developing unit 4Y supplies toner to the photosensitive drum 1Y and develops the electrostatic latent image into a toner image. A developer is supplied to the developing unit 4Y from a developer supplying unit 5Y. The developing unit 4Y can use a one-component developer including only a toner or a two-component developer including a toner and a carrier as the developer.

The primary transfer roller 92Y is pressed against the intermediate transfer belt 91, and forms a primary transfer portion T1 (primary transfer nip) between the photosensitive drum 1Y and the intermediate transfer belt 91. A primary transfer bias power supply 93Y is coupled to the primary transfer roller 92Y. The toner image having negative polarity formed on the photosensitive drum 1Y is primarily transferred to the intermediate transfer belt 91 by applying bias voltage with positive polarity from the primary transfer bias power supply 93Y to the primary transfer roller 92Y. The drum cleaning unit 7Y slides a cleaning blade against the photosensitive drum 1Y, and recovers a primary transfer residual toner remaining on the photosensitive drum 1Y after primary transfer.

The intermediate transfer belt 91 is stretched between and supported by a tension roller 94, a secondary transfer inner roller 10 and a driving roller 95, and driven by the driving roller 95 to a direction of arrow R1 in the drawing. The secondary transfer unit T2 is a transfer nip portion for transferring the toner image to the recording material P, formed by abutting a secondary transfer outer roller 96, i.e., secondary transfer member, to the intermediate transfer belt 91 stretched by the secondary transfer inner roller 10. In the secondary transfer unit T2, a secondary transfer bias is applied to the secondary transfer outer roller 96 from a secondary transfer bias power supply not shown. In accordance therewith, the toner image on the intermediate transfer belt 91 is secondarily transferred to the recording material P conveyed to the secondary transfer unit T2. At this time, a resist roller 12 conveys the recording material P to the secondary transfer unit T2 in synchronization with the passing of the primarily transferred toner image on the intermediate transfer belt 91 through the secondary transfer unit T2. A belt cleaning unit 11 slides a cleaning blade against the intermediate transfer belt 91, and collects a secondary transfer residual toner remaining on the intermediate transfer belt 91 after secondary transfer.

The recording material P having the four-color toner image secondarily transferred via the secondary transfer unit T2 is conveyed to a fixing unit 13. In the fixing unit 13, fixing rollers 13*a* and 13*b* are abutted against one another to form a fixing nip portion T3, and the fixing nip portion T3 conveys the recording material P and fixes the toner image onto the recording material P. In the fixing unit 13, a fixing roller 13*b* is pressed against a fixing roller 13*a* heated from an inner side by a lamp heater and the like (not shown), thereby forming the fixing nip portion T3. The recording material P is heated and pressed by being nipped and conveyed by the fixing nip portion T3, by which the toner image is fixed to the recording material P. The recording material P having the toner image fixed by the fixing unit 13 is discharged to an outer side of the apparatus body.

<Photosensitive Drum>

The photosensitive drum 1Y and the charging roller 2Y will be described with reference to FIG. 2. At first, the photosensitive drum 1Y will be described. The photosensitive drum 1Y is an organic photoconductor drum having a photosensitive layer 1*b* formed of an organic photoconductor (OPC) with negative charging characteristics applied on an outer circumferential surface of a drum base body 1*a* formed of aluminum or other conductive material. In the present embodiment, a photosensitive drum 1Y having an outer diameter of 30 mm is used.

The photosensitive layer 1*b* is formed by laminating, in the named order from the drum base body 1*a* side, an under coating layer (CPL) 1*b*1, an implantation inhibition layer (MCL) 1*b*2, a charge generation layer (CGL) 1*b*3, a charge transport layer (CTL) 1*b*4, and a surface protection layer (OCL) 1*b*5. The charge generation layer (CGL) 1*b*3 is formed of a phthalocyanine compound, and has a thickness of 0.2 μm, for example. The charge transport layer (CTL) 1*b*4 is formed of a polycarbonate having a hydrazone compound dispersed therein, and has a thickness of 13 μm, for example. The surface protection layer 1*b*5 is formed of an acrylic resin, and has a thickness of 5 μm, for example. The photosensitive layer 1*b* is an insulator, and has a characteristics of turning into a conductor by having light with a specific wavelength irradiated thereon. The reason for this is that positive holes (electron pairs) are generated within the charge generation layer (CGL) 1*b*3 by irradiating light, and these positive holes become bearers of the electric charge flow.

Figure 2:
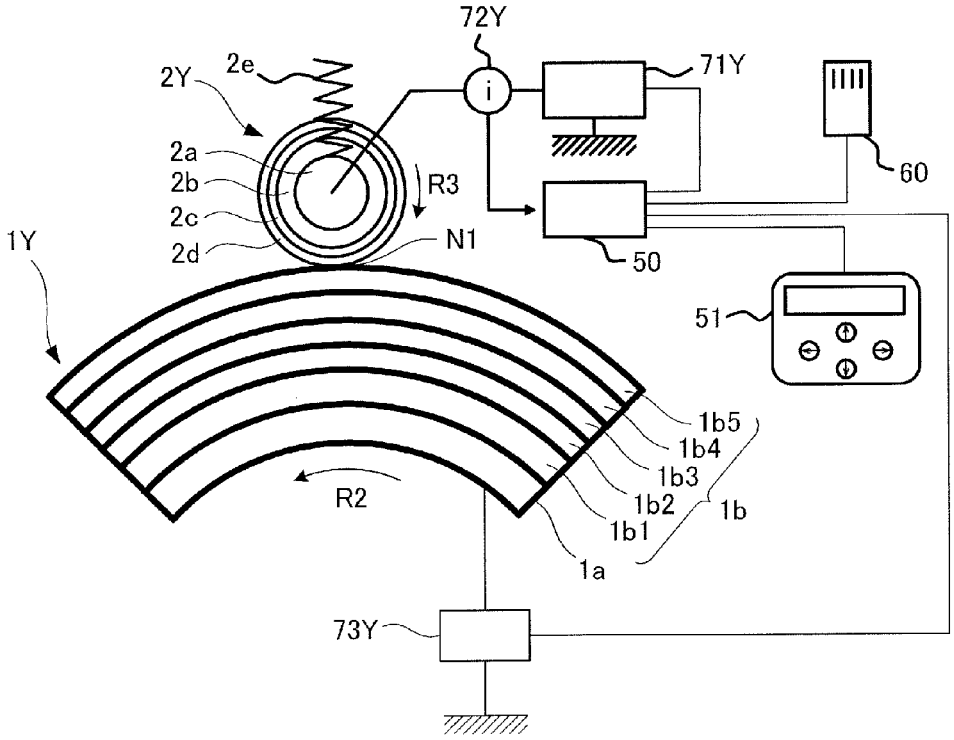
FIG. 2 is a schematic view of a photosensitive drum, a charging roller, and a charging voltage control system according to the first embodiment.

The present inventors have confirmed through experiment that according to the photosensitive drum 1Y illustrated in FIG. 2, an amount of abrasion of the photosensitive layer 1*b* when image forming is performed to a total of three hundred thousand or more sheets is 1 μm or lower. That is, in the photosensitive drum 1Y having its surface covered with the above-described surface protection layer 1*b*5, the thickness of the photosensitive layer 1*b* is scarcely varied (reduced) even when image forming is performed to a large amount of sheets. The reason for this is that the surface protection layer 1*b*5 is harder than the surface hardness of various members such as the charging roller 2Y and the cleaning blade of the drum cleaning unit 7Y that contact the photosensitive drum 1Y, and therefore, the protection layer 1*b*5 is hardly abraded by these members.

<Charging Roller>

The charging roller 2Y will now be described. As described previously, the charging roller 2Y charges the surface (outer circumferential surface) of the photosensitive drum 1Y uniformly to a predetermined polarity and potential, by having charging voltage applied to the roller. The present embodiment utilizes a charging roller 2Y having a length of 320 mm in a longitudinal direction (rotational axis direction). As shown in FIG. 2, the charging roller 2Y is formed by laminating, in the named order from a core metal 2*a* side, an elastic layer 2*b*, a resistive layer 2*c* and a surface layer 2*d* on an outer circumferential surface of the metallic core metal 2*a*. The core metal 2*a* has both end portions in a longitudinal direction (rotational axis direction) of the charging roller 2Y retained rotatably on a bearing member not shown.

The bearing member (not shown) is biased toward the photosensitive drum 1Y by a pressurizing spring (compression spring) 2*e*, i.e., biasing member. Thereby, the charging roller 2Y is pressed against the photosensitive drum 1Y, and can be driven to rotate in a direction of arrow R3 in the drawing, along with the rotation of the photosensitive drum 1Y. Further, a charging nip N1 is formed between the charging roller 2Y and the photosensitive drum 1Y by having the charging roller 2Y pressed against the photosensitive drum 1Y. A minute space (hereinafter referred to as a charging gap) is formed between the photosensitive drum 1Y and the charging roller 2Y on an upstream side and a downstream side of the charging nip N1 with respect to a direction of rotation (direction of arrow R2 in the drawing) of the photosensitive drum 1Y.

The charging roller 2Y does not necessarily have to be in contact with the photosensitive drum 1Y. As long as a dischargeable range determined by the voltage between the charging gap and a correction Paschen curve between the charging roller 2Y and the photosensitive drum 1Y is ensured, the charging roller 2Y and the photosensitive drum 1Y can be arranged in proximity in a non-contact manner with a space (clearance) therebetween in the order of tens of micrometers, for example. In other words, the charging roller 2Y and the photosensitive drum 1Y can adopt any positional relationship, as long as charging of the photosensitive drum 1Y is performed through proximity discharge.

<Charging Voltage Control System>

Now, a charging voltage control system applying voltage to the charging roller 2Y will be described with reference to FIG. 2. The charging voltage control system illustrated in FIG. 2 includes a charging high voltage power supply 71Y, a direct current measurement unit 72Y, and an alternating current measurement unit 73Y. The charging high voltage power supply 71Y is coupled to the charging roller 2Y through the core metal 2*a*. The charging high voltage power supply 71Y is a power supply capable of outputting a voltage of 0 through −900 V as a DC voltage Vdc, and a voltage of 0 through 2500 V with a frequency of 1500 Hz as an AC voltage Vac (peak-to-peak voltage), for example. The charging high voltage power supply 71Y applies a charging voltage having superimposed the DC voltage Vdc and the AC voltage Vac as charging voltage (also referred to as charging bias or charging high voltage) to the charging roller 2Y for charging the photosensitive drum 1Y. The respective voltage values of the superimposed DC voltage Vdc and the AC voltage Vac as charging voltage output from the charging high voltage power supply 71Y are set by a controller 50.

When charging voltage is applied from the charging high voltage power supply 71Y to the charging roller 2Y, discharge may occur at the charging gap created between the charging roller 2Y and the photosensitive drum 1Y. The photosensitive drum 1Y is charged by applying a charging voltage equal to or higher than a discharge starting voltage Vth to the charging roller 2Y and causing discharge to occur at the charging gap. At that time, if an AC voltage Vac twice the amount of discharge starting voltage Vth or higher is applied to the charging roller 2Y, a surface potential Vd of the photosensitive drum 1Y is converged to a potential of the DC voltage Vdc. Thus, the photosensitive drum 1Y is uniformly charged to the surface potential Vd (=Vdc).

The direct current measurement unit 72Y, i.e., direct current detection unit, is coupled to the charging high voltage power supply 71Y. The direct current measurement unit 72Y measures a DC component of a charging current flowing from the charging roller 2Y to the photosensitive drum 1Y (hereinafter referred to as a direct current Idc) in accordance with application of voltage from the charging high voltage power supply 71Y to the charging roller 2Y. The direct current measurement unit 72Y outputs the measured direct current (more precisely, a direct current value) to the controller 50.

The alternating current measurement unit 73Y is coupled to the drum base body 1*a* of the photosensitive drum 1Y. The alternating current measurement unit 73Y measures an AC component of the charging current flowing from the charging roller 2Y to the photosensitive drum 1Y (hereinafter referred to as an alternating current Iac) in accordance with the application of voltage from the charging high voltage power supply 71Y to the charging roller 2Y. The alternating current measurement unit 73Y outputs the measured alternating current (more precisely, an alternating current value) to the controller 50.

<Controller>

The image forming apparatus 100 includes the controller 50. The controller 50 will now be described with reference to FIG. 3. The controller 50, i.e., control unit, is a CPU performing various controls of the present image forming apparatus 100 including the image forming operation, for example.

Figure 3:
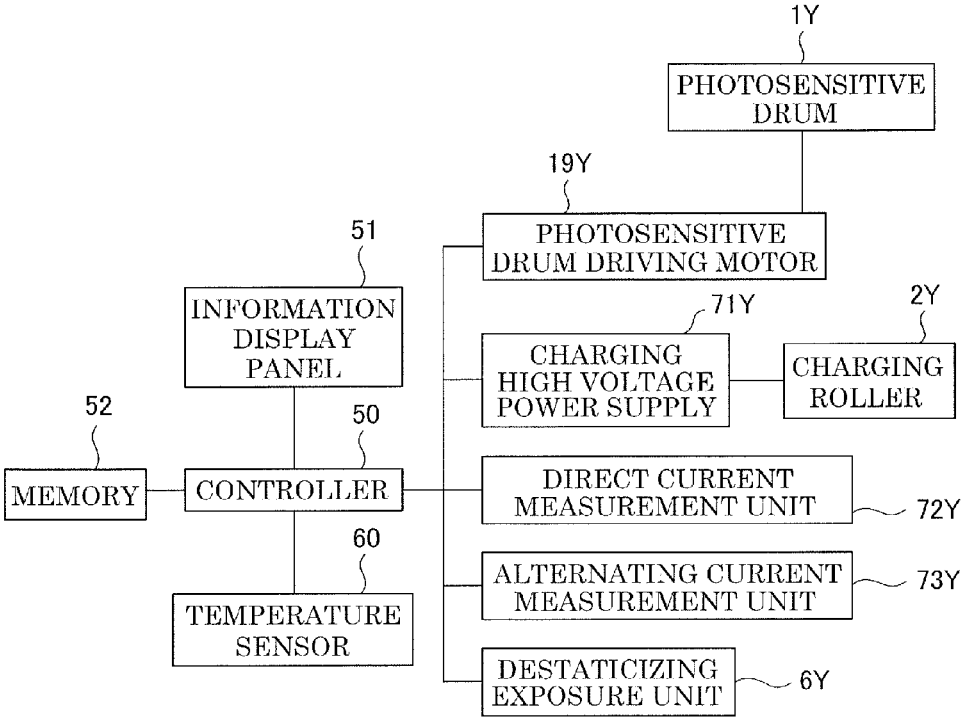
FIG. 3 is a block diagram of the charging voltage control system of the image forming apparatus according to the first embodiment.

As illustrated in FIG. 3, an information display panel 51 is connected to the controller 50 through an interface not shown. The information display panel 51 has a display unit that displays an operating status of the apparatus body, and a menu presenting various executable control programs, such as an image forming job, to a user. Further, the information display panel 51 has an operation portion that can be operated by the user when starting execution of a control program or entering data.

A memory 52 is coupled to the controller 50. The memory 52, i.e., memory unit, can be a ROM, a RAM or a hard disk storing data and various control programs for controlling the present image forming apparatus 100. The memory 52 can also temporarily store operation processing results accompanying the execution of various control programs.

In the present embodiment, the controller 50 executes an image forming job (more precisely, an image forming program) stored in the memory 52, thereby controlling the image forming apparatus 100 to perform image forming process based on image data entered from the information display panel 51 and the like. In response to the execution of the image forming job, the controller 50 performs control of the photosensitive drum 1Y (more precisely, the photosensitive drum driving motor 19Y), the charging roller 2Y (more precisely, the charging high voltage power supply 71Y), and the destaticizing exposure unit 6Y. Of course, the controller 50 can control various units described earlier other than these units (refer to FIG. 1), but they will not be illustrated or described, since they do not relate to the main object of the present embodiment.

A temperature sensor 60, i.e., temperature detecting unit, is coupled to the controller 50 through an interface not shown. The temperature sensor 60 is arranged at a location distant from the charging roller 2Y within the apparatus body (refer to FIG. 1), and detects the temperature within the apparatus body. The controller 50 acquires the temperature within the apparatus body from the temperature sensor 60.

The photosensitive drum driving motor 19Y driving the photosensitive drum 1Y is coupled to the controller 50. The photosensitive drum driving motor 19Y is driven according to a signal (command) transmitted from the controller 50, and rotates the photosensitive drum 1Y at a predetermined rotational speed or stops the rotation of a rotating photosensitive drum 1Y.

The controller 50 controls the charging high voltage power supply 71Y to apply a charging voltage having superimposed the DC voltage Vdc and the AC voltage Vac to the charging roller 2Y, to thereby charge the photosensitive drum 1Y to a predetermined potential (surface potential Vd). The DC voltage Vdc of the charging voltage is determined to a predetermined voltage value associated in advance to a desirable surface potential Vd for charging the photosensitive drum 1Y. For example, if the photosensitive drum 1Y should be charged to a potential of "−600 V", the DC voltage Vdc is set to "−600 V", and if the photosensitive drum 1Y should be charged to a potential of "−500 V", the DC voltage Vdc is set to "−500 V".

Moreover, the DC voltage Vdc is associated in advance with predetermined temperatures so that the photosensitive drum 1Y can be constantly charged to the same surface potential Vd, even if a resistance of the charging roller 2Y is varied in accordance with the temperature and the like within the apparatus body. For example, if the photosensitive drum 1Y is to be charged to a potential of "−500 V", the DC voltage Vdc is set to "−520 V" if the temperature is lower than 15° C., and the DC voltage Vdc is set to "−500 V" if the temperature is 15° C. or higher. The corresponding relationship between the surface potential Vd and the DC voltage Vdc of the photosensitive drum 1Y for each predetermined temperature range is stored in advance in the memory 52 as a table (not shown) and the like.

On the other hand, the AC voltage Vac of the charging voltage is set to an arbitrary peak-to-peak voltage in accordance with the temperature within the apparatus body. In the present embodiment, an AC constant current control is performed, controlling the alternating current Iac being flown by applying the AC voltage Vac to the charging roller 2Y. The above-mentioned charging high voltage power supply 71Y, the direct current measurement unit 72Y and the alternating current measurement unit 73Y are coupled to the controller 50 as the charging voltage control system. The controller 50 determines the AC voltage Vac based on the direct current Idc and the alternating current Iac respectively measured by the direct current measurement unit 72Y and the alternating current measurement unit 73Y. The controller 50 performs charging voltage control, and applies a charging voltage capable of causing discharge sufficient to charge the photosensitive drum 1Y to a desired surface potential Vd in a uniform manner to the charging roller 2Y. The charging voltage control will be described later (refer to FIG. 4).

Further, the controller 50 controls an intensity of light irradiated by the destaticizing exposure unit 6Y to destaticize the photosensitive drum 1Y. The controller 50 controls the destaticizing exposure unit 6Y to irradiate a light with an exposure value of approximately 1 $\mu J/cm^2$ as the intensity of light, but the value is not restricted to 1 $\mu J/cm^2$, as long as the intensity of light is sufficient to destaticize the photosensitive drum 1Y.

Figure 4:
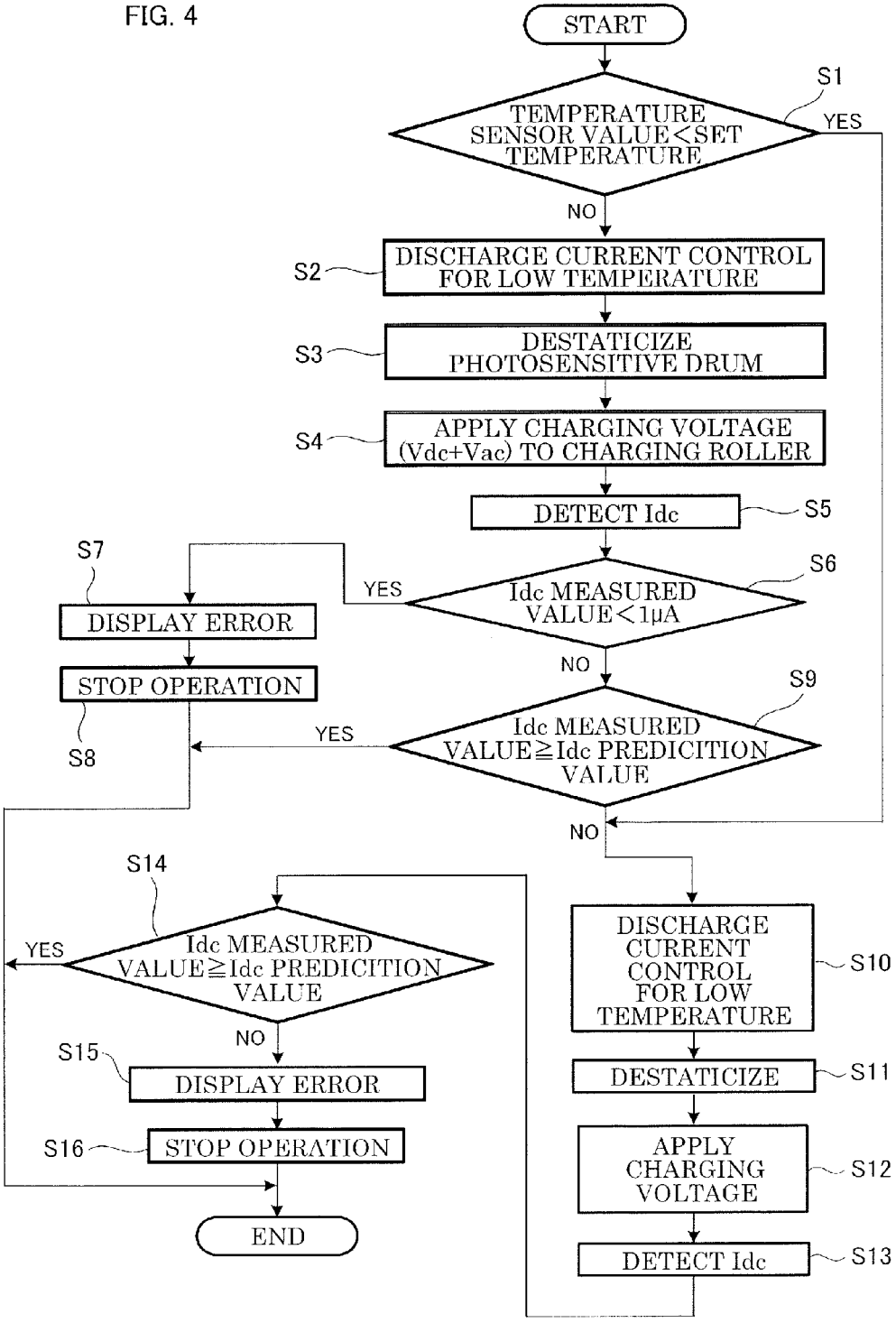
FIG. 4 is a flowchart showing processes of charging voltage control according to the first embodiment.

Next, a charging voltage control executed by the controller 50 will be described with reference to FIG. 4. FIG. 4 is a flowchart of a charging voltage control according to a first embodiment. The charging voltage control illustrated in FIG. 4 is a control that can be applied to an image forming apparatus of a type that determines the AC voltage Vac by performing respective discharge current controls for normal temperature and for low temperature in accordance with the temperature within the apparatus body detected by the temperature sensor 60 (refer to FIG. 5B described later). The charging voltage control illustrated in FIG. 4 is performed for each of the image forming units UY, UM, UC and UK, but for sake of description, the image forming unit UY will be illustrated as an example. The same description applies for the charging voltage control of the other image forming units UM, UC and UK, by replacing the symbol Y on the end of reference numbers in the description with M, C or K.

The charging voltage control illustrated in FIG. 4 is started by the controller 50, such as when starting the image forming job, or when the power of the apparatus body is turned on. Now, the image forming job refers to a series of operations from the start of image forming operation to the completion of the image forming operation based on a print signal for forming an image on a recording medium. That is, it refers to a series of operations from when a preliminary operation (so-called a pre-rotation operation) required for performing image forming is started, during image forming steps, and until the preliminary operation required in ending the image forming (so-called post-rotation operation) is completed. Actually, it refers to a series of operations from when pre-rotation is performed after receiving a print signal (entry of the image forming job) (preparation operation prior to image forming) to when post-rotation is performed (operation after image forming), and it includes an image forming period and sheet intervals. The controller 50 performs charging voltage control during the pre-rotation operation, for example, to determine an appropriate AC voltage Vac (peak-to-peak voltage) regarding the charging voltage applied to the charging roller 2Y when charging the photosensitive drum 1Y in the subsequent image forming process.

The controller 50 determines whether a temperature within the apparatus body (temperature sensor value) acquired from the temperature sensor 60 is lower than a predetermined temperature (set temperature) (for example, lower than 15° C.) (S1). If the temperature acquired from the temperature sensor 60 is a high temperature (corresponding to a first temperature) equal to or higher than the predetermined temperature (set temperature) (S1: No), the controller 50 executes a discharge current control for normal temperature and determines the AC voltage Vac (corresponding to a first AC voltage) of the charging voltages (S2). On the other hand, if the temperature acquired from the temperature sensor 60 is a low temperature (corresponding to a second temperature) lower than the predetermined temperature (set temperature) (S1: YES), the controller 50 jumps to the process of S10, executes discharge current control for low temperature, and determines the AC voltage Vac (corresponds to the second AC voltage) of the charging voltage (S10). The controller 50 determines the DC voltage Vdc corresponding to the desired surface potential Vd to be charged to the photosensitive drum 1Y in accordance with the temperature acquired from the temperature sensor 60.

In the present embodiment, the controller 50 performs "AC constant current control" controlling the charging of the photosensitive drum 1Y by a total amount of current of the alternating current Iac flowing from the charging roller 2Y to the photosensitive drum 1Y. The total amount of current of the alternating current Iac is the sum of a nip current flowing through the charging nip N1 which is a contact portion between the charging roller 2Y and the photosensitive drum 1Y and a discharge current flown by the occurrence of discharge at the charging gap, which is a non-contact portion. In AC constant current control, control is performed to include not only the discharge current required for actually charging the photosensitive drum 1Y, but also the nip current. However, even when control is performed with the same current value, if the resistance of the charging roller 2Y is changed in accordance with the temperature within the apparatus body, the amount of discharge current will be reduced as the nip current increases, and the amount of discharge current will be increased as the nip current reduces. Therefore, even if AC constant current control had been performed, it was difficult to uniformly charge the photosensitive drum 1Y to the desired surface potential. Therefore, according to the present embodiment, different discharge current controls for determining the AC voltage (peak-to-peak voltage) for acquiring a constant amount of discharge current are performed for normal temperature and for low temperature, in order to acquire the amount of discharge current in accordance with the temperature within the apparatus body.

Figures 5A, 5B:
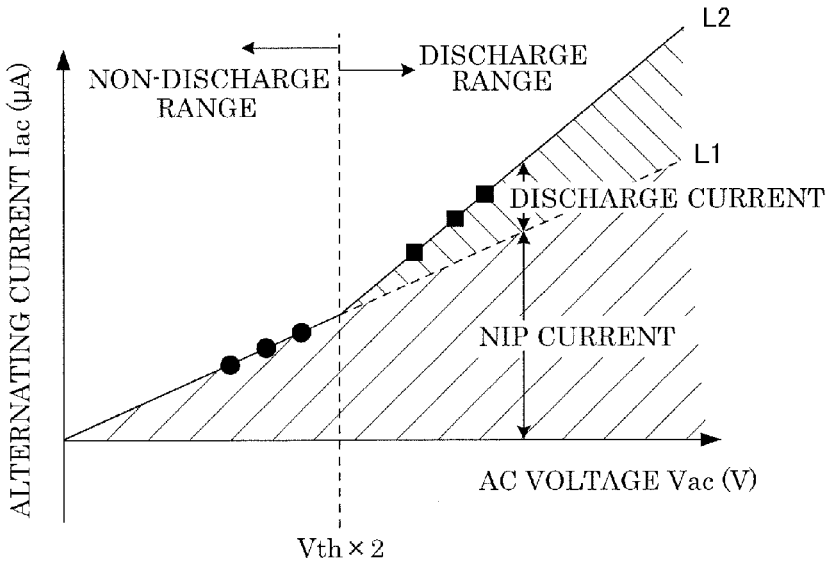
FIG. 5A is a view illustrating a relationship between AC voltage and alternating current in the discharge current control according to the first embodiment.
FIG. 5B is a view illustrating a normal temperature table and a low temperature table according to the first embodiment.

A discharge current control for normal temperature (S2) and a discharge current control for low temperature (S10) are described with reference to FIGS. 5A and 5B. The controller 50 controls the charging high voltage power supply 71Y, and sequentially applies three points of AC voltage Vac in a non-discharge range (refer to black circles in the drawing) and three points of AC voltage Vac in a discharge range (refer to black squares in the drawing) to the charging roller 2Y, as illustrated in FIG. 5A. When a discharge start voltage between the charging roller 2Y and the photosensitive drum 1Y is set to Vth, a range lower than twice the amount of discharge starting voltage Vth corresponds to the non-discharge range, and a range equal to or higher than twice the amount of discharge starting voltage Vth corresponds to the discharge range. The controller 50 sets an application time of each AC voltage Vac to 200 ms, for example, and during that time, the alternating current Iac flowing from the charging roller 2Y to the photosensitive drum 1Y is acquired from the alternating current measurement unit 73Y. Then, the controller 50 averages the current value of the alternating current Iac acquired during the application time of 200 ms.

The controller 50 performs linear approximation of an average current value of each of the three points described above using an appropriate method, such as a least squares method, and seeks approximate straight lines L1 and L2 respectively representing corresponding relationships between the AC voltage Vac and the alternating current Iac for the non-discharge range and the discharge range. The difference between the approximate straight line L1 and the approximate straight line L2 is the amount of discharge current, so that the controller 50 calculates the AC voltage Vac for realizing the desired amount of discharge current based on an approximate expression representing these approximate straight lines L1 and L2. Based on studies performed in advance by the present inventors, it has been confirmed that according to the present embodiment, the photosensitive drum 1Y could be uniformly charged to the desired surface potential Vd regardless of the temperature within the apparatus body, when the amount of discharge current is set to 30 through 100 μA, preferably 50 μA. Therefore, it is preferable to decide the AC voltage Vac with an amount of discharge current of 50 μA.

As described, in the discharge current control, three points of AC voltage Vac in the non-discharge range and three points of AC voltage Vac in the discharge range are sequentially applied to the charging roller 2Y. The six points of applied voltages are varied between the discharge current control for normal temperature and the discharge current control for low temperature. In the present embodiment, three points of AC voltage Vac of 1100 V, 1200 V and 1300 V in the non-discharge range and three points of AC voltage Vac of 1600 V, 1700 V and 1800 V in the discharge range are applied during discharge current control for normal temperature. On the other hand, three points of AC voltage Vac of 1600 V, 1700 V and 1800 V in the non-discharge range and three points of AC voltage Vac of 2100 V, 2200V and 2300 V in the discharge range are applied during discharge current control for low temperature. These six points of AC voltage Vac are respectively separately set in a normal temperature table and a low temperature table, and stored in advance in the memory 52, as shown in FIG. 5B. The normal temperature (15° C. or higher) table and the low temperature (lower than 15° C.) table are obtained by accurately measuring the temperature in the vicinity of the charging roller 2Y, and carrying out tests applying a predetermined AC voltage Vac to the charging roller 2Y for the respective cases of normal temperature and low temperature.

As can be seen from FIG. 5B, the AC voltages Vac of 1600 V, 1700 V and 1800 V in the discharge range in the normal temperature table are included in the non-discharge range in the low temperature table. That is, the areas of the non-discharge range and the discharge range differ between normal temperature and low temperature. This is because the resistance of the charging roller 2Y is varied by the temperature variation of the charging roller 2Y, and the discharge starting voltage is varied therewith. The discharge starting voltage Vth is increased as the resistance of the charging roller 2Y increases, and reduced as the resistance of the charging roller 2Y reduces. The resistance of the charging roller 2Y is increased in low temperature, so that the discharge starting voltage Vth is increased compared to the case of normal temperature.

Therefore, the non-discharge range in low temperature includes 1600 V, 1700 V and 1800 V, which are included in the discharge range in the case of normal temperature, and the discharge range during low temperature includes a higher voltage (2100 V or higher in this example) compared to the case of normal temperature.

In the above-described discharge current control, three points of AC voltage Vac in the non-discharge range and three points of AC voltage Vac in the discharge range have been applied sequentially to the charging roller 2Y, but the present embodiment is not restricted to such arrangement. As long as an approximate expression representing the above-mentioned approximate straight lines L1 and L2 can be obtained, for example, at least one point in the non-discharge range and at least two different points in the discharge range may be sequentially applied.

Returning to the description of FIG. 4, the controller 50 controls the destaticizing exposure unit 6Y and destaticizes the photosensitive drum 1Y (S3) after completing the discharge current control for normal temperature (S2). Next, the controller 50 controls the charging high voltage power supply 71Y to apply the charging voltage having superimposed the already determined DC voltage Vdc (−600 V, for example) and the AC voltage Vac acquired as a result of performing discharge current control for normal temperature (1550 V, for example) to the charging roller 2Y (S4). At this time, the AC voltage Vac is subjected to constant voltage control. Thereby, the photosensitive drum 1Y is charged. The controller 50 acquires the direct current Idc flowing from the charging roller 2Y to the photosensitive drum 1Y by applying the charging voltage from the direct current measurement unit 72Y (S5). If the temperature acquired from the temperature sensor 60 is equal to or higher than a predetermined temperature (S1: NO), the controller 50 executes the processes illustrated in S2 through S5 as a first mode. When executing the first mode, discharge current control is executed using a plurality of AC voltages Vac corresponding to a first temperature.

The controller 50 judges whether the direct current Idc acquired from the direct current measurement unit 72Y (hereinafter referred to as a first measured value) is lower than 1 μA (S6). In the present embodiment, when comparing the acquired direct current value with a set value, an absolute value of the acquired direct current value is compared with the set value. If the first measured value (absolute value) is lower than 1 μA (S6: YES), the controller 50 judges that the direct current Idc is not flown, displays an error on the information display panel 51 (S7), and if an image forming job is being executed, the controller 50 suspends the job and stops the operation of the apparatus body (S8). Possible reasons why the direct current Idc is not flown includes cases where the photosensitive drum 1Y is not rotated or the photosensitive drum 1Y is not destaticized. In these cases, not enough potential difference occurs between the charging roller 2Y and the photosensitive drum 1Y, so that only very little direct current Idc flows. In the present example, the first measured value is compared with 1 μA and not with 0 μA, because the value measured by the direct current measurement unit 72Y may be dispersed within a range of approximately plus or minus 1 μA. If the value measured by the direct current measurement unit 72Y is not dispersed, the above-mentioned determination of whether error has occurred can be determined by whether 0 μA or higher direct current Idc has flown.

If the first measured value is 1 μA or higher (S6: NO), the controller 50 determines whether the first measured value is equal to or higher than an Idc prediction value (equal to or higher than set value) (S9). Now, when the photosensitive drum 1Y is charged by raising the surface potential Vd from 0 V to the potential of the DC voltage Vdc, the direct current Idc flowing from the charging roller 2Y to the photosensitive drum 1Y is acquired through expression 1 shown below.

$$|IDC| = \in \cdot \in 0 \cdot L \cdot vp \cdot Vdc/d \qquad \text{(Expression 1)}$$

In expression 1, d represents a film thickness of the photosensitive layer 1*b* in an initial state (refer to FIG. 2), ∈ represents a relative dielectric constant, ∈0 represents a dielectric constant in vacuum, L represents an effective chargeable width of the charging roller 2Y, and vp represents a rotational speed (process speed) of the photosensitive drum 1Y.

Specifically, for example, if the relative dielectric constant ∈ is 2.5, the dielectric constant ∈0 in vacuum is $8.854\times10^{-12}$ F/m, the effective chargeable width L is 320 mm, the rotational speed vp is 250 mm/s, and the film thickness d of the photosensitive layer 1*b* is 18 μm, expression 1 can be simplified as expression 2 shown below. A predetermined Idc prediction value (set value) can be obtained from expression 2. The Idc prediction value is a prediction value of the DC component of the charging current flowing from the charging roller 2Y to the photosensitive drum 1Y when charging the photosensitive drum 1Y to a predetermined potential (potential of DC voltage Vdc).

$$|Idc \text{ prediction value}| \approx Vdc/10 \quad \text{(Expression 2)}$$

According to expression 2, when applying −600 V as the DC voltage Vdc to the charging roller 2Y, the Idc prediction value is calculated as 60 μA. However, since there is a dispersion of approximately plus or minus 1 μA of the measurement value measured by the direct current measurement unit 72Y, in this case, the Idc prediction value is set to 59 μA. The controller 50 compares the Idc prediction value calculated based on above expression 2 with a measured value. At this time, if the temperature within the apparatus body detected by the temperature sensor 60 is the same as the actual temperature of the vicinity of the charging roller 2Y, the Idc prediction value and the measured value will be the same. The dispersion of the measurement value is varied greatly by the direct current measurement unit 72Y being used, so that obviously, the Idc prediction value is not restricted to 59 μA.

If the first measured value is equal to or higher than the Idc prediction value (S9: YES), the controller 50 judges that a sufficient amount of discharge current has been obtained for charging the photosensitive drum 1Y to a desired surface potential in a uniform manner as a result of executing the first mode (S2 through S5), and ends the present charging voltage control. In this case, when charging the photosensitive drum 1Y, the controller 50 controls the charging high voltage power supply 71Y to apply the charging voltage including the AC voltage Vac determined by the discharge current control for normal temperature to the charging roller 2Y.

On the other hand, if the first measured value is not equal to or higher than the Idc prediction value regardless of executing the first mode (S2 through S5) (S9: NO), the controller 50 executes the processes of S10 through S13 as the second mode. In that case, the controller 50 determines that the temperature of the vicinity of the charging roller 2Y (corresponding to a second temperature) is lower than the temperature acquired from the temperature sensor 60, so the controller 50 executes the discharge current control for low temperature, and determines the AC voltage Vac (corresponding to second AC voltage) of the charging voltage (S10). As described, when executing the second mode, discharge current control is executed using a plurality of AC voltages Vac corresponding to the second temperature. Thereafter, the controller 50 controls the destaticizing exposure unit 6Y and destaticizes the photosensitive drum 1Y (S11). Next, the controller 50 controls the charging high voltage power supply 71Y to apply a charging voltage having superimposed the predetermined DC voltage Vdc (such as −600 V) and the AC voltage Vac (such as 2050V) obtained as a result of performing discharge current control for low temperature to the charging roller 2Y (S12). At this time, the AC voltage Vac is subjected to constant voltage control. Thereby, the photosensitive drum 1Y is charged. The controller 50 acquires the direct current Idc flowing from the charging roller 2Y to the photosensitive drum 1Y in accordance with the application of the charging voltage from the direct current measurement unit 72Y (S13).

The controller 50 judges whether the measured value (hereinafter referred to as a second measured value) acquired from the direct current measurement unit 72Y is equal to or higher than the Idc prediction value (S14). If the second measured value is equal to or higher than the Idc prediction value (S14: YES), the controller 50 determines that a sufficient amount of discharge current has been acquired for charging the photosensitive drum 1Y to a desired surface potential in a uniform manner as a result of executing the second mode (S10 through S13), and ends the present charging voltage control. In this case, when charging the photosensitive drum 1Y, the controller 50 controls the charging high voltage power supply 71Y to apply the charging voltage including the AC voltage Vac determined based on the discharge current control for low temperature to the charging roller 2Y.

If the second measured value is not equal to or higher than the Idc prediction value (S14: NO), the controller 50 displays an error on the information display panel 51 (S15), and if an image forming job is being executed, the controller 50 suspends the job and stops the operation of the apparatus body (S16).

As described above, in the image forming apparatus 100 of the present embodiment, the DC component of the charging current actually flowing from the charging roller 2Y to the photosensitive drum 1Y is measured, when an AC voltage Vac determined in accordance with the temperature within the apparatus body detected by the temperature sensor 60 is applied. Whether a charging current capable of realizing sufficient charge is flown to the photosensitive drum 1Y can be judged by comparing the DC component (measured value) of the measured charging current with the Idc prediction value stored in advance in the memory 52. If the measured value is lower than the prediction value, it means that not enough charging current for realizing sufficient charge is flown to the photosensitive drum 1Y, so that an AC voltage Vac that differs from the AC voltage Vac determined based on the temperature within the apparatus body is determined in accordance with a temperature lower than the temperature within the apparatus body. Then, the AC voltage Vac determined in accordance with the lower temperature is applied to the charging roller 2Y. Thereby, a charging current capable of realizing sufficient charging can be flown to the photosensitive drum 1Y, even if the resistance of the charging roller 2Y has been fluctuated. Therefore, even in a case where the temperature within the apparatus body differs from the temperature of the vicinity of the charging roller 2Y, the photosensitive drum 1Y can be charged uniformly to a desired surface potential.

Second Embodiment

The first embodiment described above has illustrated an example where respective discharge current controls are performed for normal temperature and for low temperature (refer to S2 and S10 of FIG. 4) in accordance with the temperature within the apparatus body detected by the temperature sensor 60, but the image forming apparatus is not restricted to such embodiment. For example, there is another type of image forming apparatus where AC voltage Vac associated with predetermined temperature is stored in advance in the memory 52, and the AC voltage Vac is applied in accordance with the temperature within the apparatus body based on the stored value. FIG. 6 illustrates an AC voltage table stored in the memory 52. In this example, the AC voltage Vac stored in the memory 52 is obtained by sequentially applying arbitrary AC voltages Vac with the temperature within the apparatus body experimentally set to predetermined temperature, and storing the AC voltage Vac capable of realizing the desired amount of discharge current for each temperature. Therefore, as shown in the AC voltage table of FIG. 6, the AC voltage Vac is associated with a predetermined temperature (more precisely, the temperature range), and stored.

Figure 7:
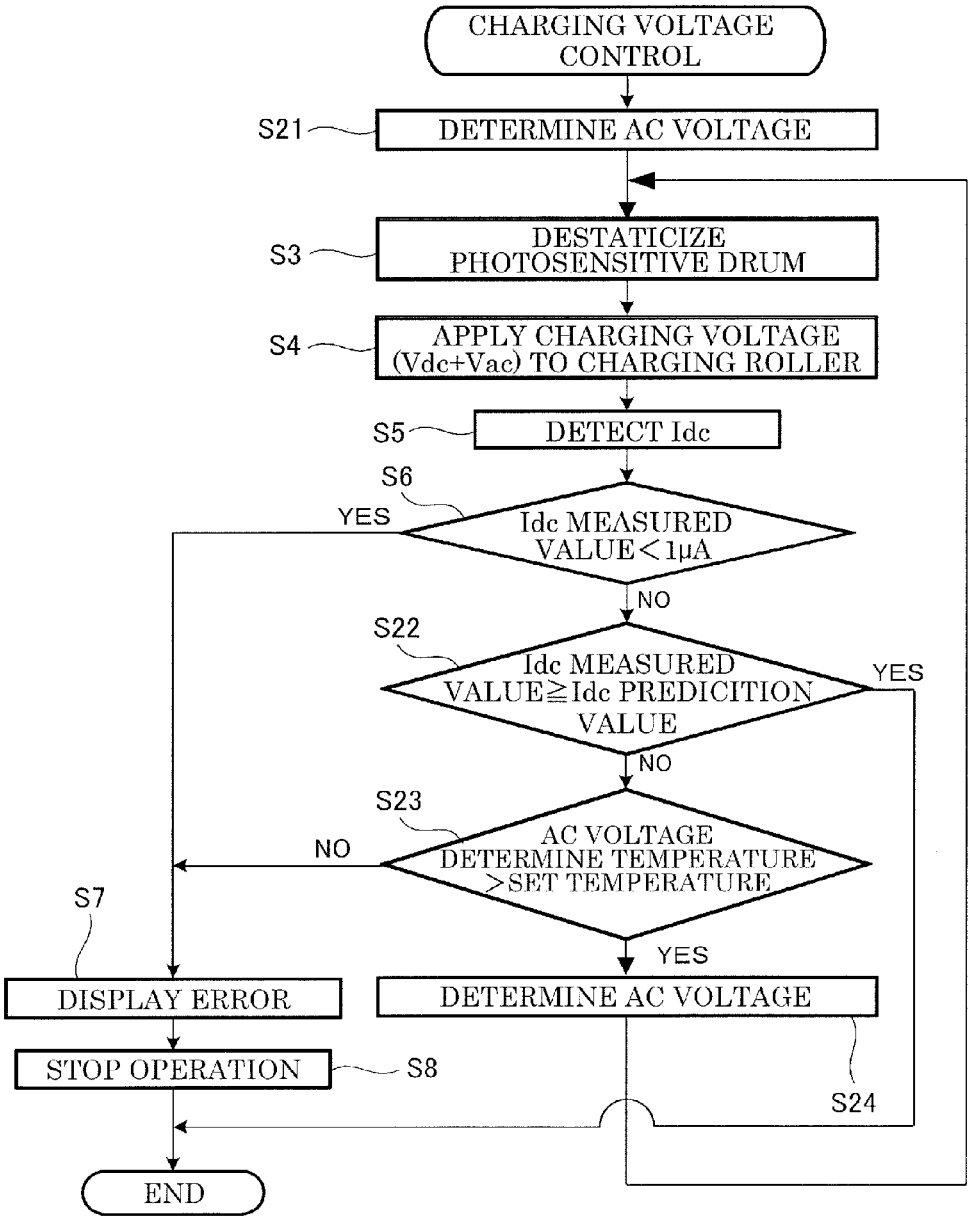
FIG. 7 is a flowchart illustrating a charging voltage control process according to the second embodiment.

A charging voltage control that can be applied to the type of image forming apparatus determining the AC voltage Vac using the AC voltage table illustrated in FIG. 6 will be described with reference to FIG. 7. FIG. 7 is a flowchart illustrating a charging voltage control according to a second embodiment. The charging voltage control illustrated in FIG. 7 is started by the controller 50 when an image forming job is started or a power of the apparatus body is turned on, similar to the charging voltage control illustrated in FIG. 4. The charging voltage control illustrated in FIG. 7 is performed for each of the image forming units UY, YM, UC and UK, but for sake of description, the image forming unit UY will be taken as an example in the present description. Further, the processes of S3 through S8 of the charging voltage control illustrated in FIG. 7 are similar to the processes of S3 through S8 of the charging voltage control of the first embodiment illustrated in FIG. 4, so that they will not be described in detail here.

The controller 50 determines the AC voltage Vac (peak-to-peak voltage) in accordance with the temperature within the apparatus body acquired from the temperature sensor 60 (temperature sensor value) (S21). For example, the AC voltage Vac (corresponding to a first AC voltage) associated with the temperature (corresponding to a first temperature) within the apparatus body is determined based on the AC voltage table illustrated in FIG. 6. For example, if the temperature within the apparatus body is 22° C., the AC voltage Vac is set to 1700 V (refer to FIG. 6).

The controller 50 destaticizes the photosensitive drum 1Y (S3), applies the charging voltage having superimposed the predetermined DC voltage Vdc and the AC voltage Vac determined as described above to the charging roller 2Y (S4), and acquires the direct current Idc detected by the direct current measurement unit 72Y (S5). The controller 50 determines whether the measured value of the direct current Idc is lower than 1 μA (S6), and if the measured value is lower than 1 μA (S6: YES), the controller 50 displays an error on the information display panel 51 (S7), suspends the image forming job, and stops the operation of the apparatus body (S8).

If the measured value of the direct current Idc is equal to or higher than 1 μA (S6: NO), the controller 50 determines whether the measured value is equal to or higher than the Idc prediction value (S22). If the measured value is equal to or higher than the Idc prediction value (S22: YES), the controller 50 judges that an amount of discharge current sufficient for charging the photosensitive drum 1Y to a desired surface potential in a uniform manner is obtained. Therefore, the controller 50 ends the present charging voltage control, and continues the image forming job. In this case, when charging the photosensitive drum 1Y, the controller 50 controls the charging high voltage power supply 71Y to apply the charging voltage including the determined AC voltage Vac to the charging roller 2Y. On the other hand, if the measured value of the direct current Idc is not equal to or higher than the Idc prediction value (S22: NO), the controller 50 determines whether the temperature based on which the AC voltage Vac has been determined (AC voltage determination temperature) is higher than a predetermined temperature (set temperature) (for example, higher than 0° C.) (S23).

If the AC voltage determination temperature is higher than the predetermined temperature (S23: YES), the controller 50 selects a temperature lower than the AC voltage determination temperature, and determines the AC voltage Vac in accordance with the selected temperature (S24). For example, if the temperature when the AC voltage Vac has been determined to 1700 V is 22° C., a temperature of 17° C. is selected as the temperature lower than that temperature, and the AC voltage Vac is determined to be 1900 V (refer to FIG. 6). As described, a lower temperature is selected from the AC voltage table illustrated in FIG. 6, and the AC voltage Vac associated with the selected temperature is determined. Thereafter, the controller 50 returns to the process of S3, and repeatedly performs the processes of S3 through S6 and S22 through S24 (corresponding to the second mode). That is, each time these processes are repeatedly performed, the AC voltage determination temperature is gradually lowered from the temperature within the apparatus body detected by the temperature sensor 60. When charging the photosensitive drum 1Y, the controller 50 controls the charging high voltage power supply 71Y to apply the charging voltage including the AC voltage Vac (corresponding to the second AC voltage) corresponding to the temperature (corresponding to the second temperature) when the measured value of the direct current Idc has become equal to or higher than the Idc prediction value to the charging roller 2Y.

If the AC voltage determination temperature is a low temperature equal to or lower than a predetermined temperature (S23: NO), the controller 50 displays an error on the information display panel 51 (S7), suspends the image forming job, and stops the operation of the apparatus body (S8).

According to this arrangement, an effect similar to the first embodiment described above can be achieved even in the case of the image forming apparatus where the AC voltage Vac is determined using the AC voltage table illustrated in FIG. 6. That is, even if the temperature within the apparatus body and the temperature at the vicinity of the charging roller 2Y differ, an appropriate AC voltage Vac capable of removing the effect of fluctuation of resistance of the charging roller 2Y can be applied, and the photosensitive drum 1Y can be charged to the desired surface potential in a uniform manner.

Other Embodiments

According to the first and second embodiments described above, the AC voltage Vac has been determined by performing discharge current control (refer to S2 and S10 of FIG. 4), or based on an AC voltage table (refer to FIG. 6), but are not restricted thereto. For example, the controller 50 can determine the AC voltage Vac by calculating expression 3 shown below.

$$Vac(V)=2500-\sigma/15\times500 \quad \text{(Expression 3)}$$

In the expression, σ represents temperature (° C.). Fractions after the decimal point are rounded up or rounded down to determine the AC voltage Vac. If the temperature is below 0° C., the AC voltage Vac is set to 2500 V.

The above-described embodiments illustrate an example using a photosensitive drum 1Y having a photosensitive layer 1*b* whose film thickness will not be varied greatly, since it is covered with a surface protection layer (OCL) 1*b*5. However, in some type of photosensitive drums 1Y, the film thickness of the photosensitive layer 1*b* of the photosensitive drum 1Y is reduced through long term use by being abraded by a charging roller 2 and so on. If the film thickness of the photosensitive layer 1*b* is reduced, there may be cases where the prediction values stored in advance in the memory 52 are not suitable as values to be compared with the measured value. That is, since expression 1 includes the film thickness d of the photosensitive layer 1*b* as a variable, in expression 2 mentioned earlier used for calculating the prediction value, the Idc prediction value is varied by the film thickness d of the photosensitive layer 1*b*. Therefore, prior to executing the above-mentioned charging voltage control, the controller 50 changes the Idc prediction value in accordance with the film thickness of the photosensitive drum 1Y, and executes control for storing the value in the memory 52.

Figure 8:
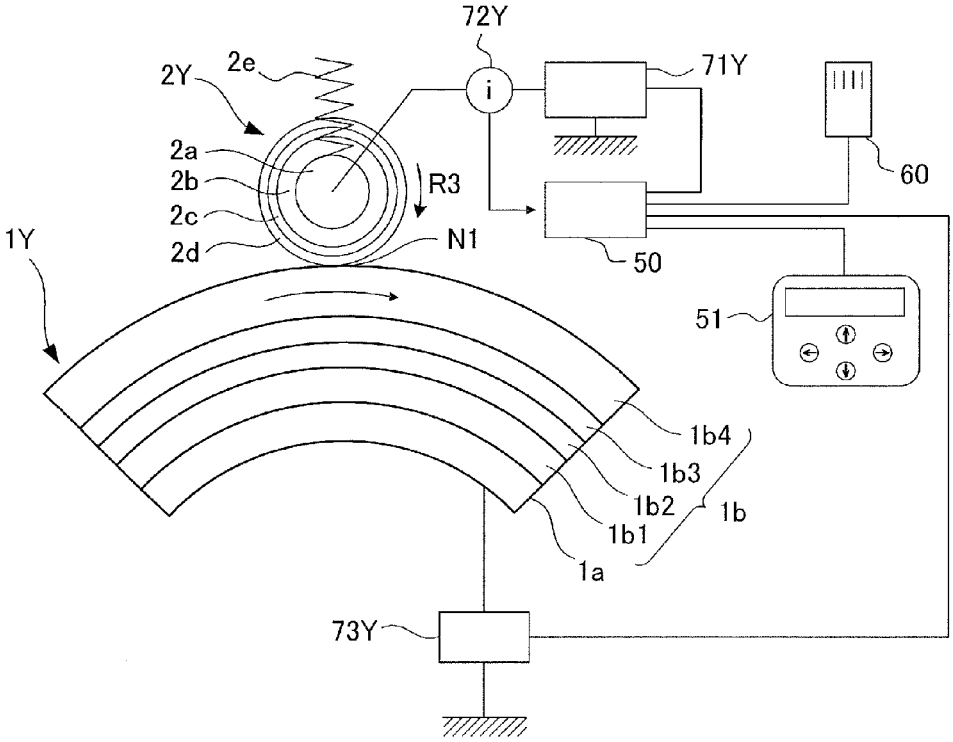
FIG. 8 is a schematic view illustrating a photosensitive drum with a varying film thickness, a charging roller, and a charging voltage control system according to another embodiment.

Now, FIG. 8 illustrates an example of the photosensitive drum 1Y having a photosensitive layer 1*b* whose film thickness may possibly be reduced. The photosensitive drum 1Y illustrated in FIG. 8 has the photosensitive layer 1*b* composed of four layers, which are the under coating layer (CPL) 1*b*1, the implantation inhibition layer (MCL) 1*b*2, the charge generation layer (CGL) 1*b*3, and the charge transport layer (CTL) 1*b*4. That is, unlike the photosensitive drum 1Y illustrated in FIG. 2, the present photosensitive drum 1Y does not include a surface protection layer (OCL) 1*b*5 formed of a relatively hard material compared to the above-mentioned layers. According to the photosensitive drum 1Y illustrated in FIG. 8, the amount of abrasion of the photosensitive layer 1*b* (more precisely, the charge transport layer 1*b*4) after forming images to approximately 10000 sheets in total was approximately 2.9 μm.

According to the photosensitive drum 1Y without the surface protection layer as illustrated in FIG. 8, the film thickness d of the photosensitive layer 1*b* may be reduced from the initial state through use. Therefore, the film thickness d of the photosensitive layer 1*b* must be measured. The film thickness d can be calculated based on an accumulated application time of the charging voltage to the charging roller 2Y and an accumulated operation time during which the photosensitive drum 1Y has been rotated. In other words, the controller 50 respectively accumulates the application time of voltage and the operation time from when the present image forming apparatus has initially been started, and stores the information in the memory 52. Thereafter, expression 4 shown below is calculated to obtain the film thickness d.

$$d=30-\alpha\times(\beta\times\text{application time of voltage}-(\text{operation time}-\text{application time of voltage})) \quad \text{(expression 4)}$$

Now, α and β are constants, and for example, α is $2.4\times10^{-6}$, and β is 24. Further, the accumulated application time of voltage and operation time are shown in seconds.

Based on the film thickness d obtained from expression 4, the controller 50 transforms expression 1 to obtain an expression similar to expression 2, calculates the Idc prediction value based on the expression, and changes the prediction value stored in the memory 52 as needed. According to this arrangement, even when using a photosensitive drum 1Y of a type where the film thickness of the photosensitive layer 1*b* is varied relatively significantly, an appropriate AC voltage Vac can be determined by performing the charging voltage control illustrated in FIG. 4 or FIG. 7.

Obviously, the film thickness d of the photosensitive layer 1*b* can be obtained not only through the method for calculating a theoretical formula such as expression 4, but by actually measuring the film thickness d of the photosensitive layer 1*b* through use of methods such as an electrostatic capacitance method.

The above-described embodiment has illustrated an example where the temperature sensor 60 is disposed as a temperature detecting unit, but a humidity sensor can be disposed instead of the temperature detecting unit. That is, the discharge starting voltage Vth may be influenced by the humidity within the apparatus body. Therefore, the controller 50 can use humidity acquired by the humidity sensor instead of temperature when performing the above-described charging voltage control, and calculate the AC voltage Vac in the above-described manner. Moreover, the temperature sensor and the humidity sensor can be used together to calculate the AC voltage Vac in the above-described manner based on the combination of temperature and humidity. In another example, there is no need to provide any environment information detecting unit, such as the temperature sensor and the humidity sensor.

The above-described embodiments have been described taking an intermediate transfer-type image forming apparatus 100 as an example, in which toner images of respective colors are primarily transferred from the photosensitive drums 1Y through 1K corresponding to the respective colors to the intermediate transfer belt 91, and then the superposed toner images of respective colors are collectively secondarily transferred to the recording material P, but the image forming apparatus is not restricted to this example. For example, the image forming apparatus can be a direct transfer-type image forming apparatus where image is directly transferred from the photosensitive drums 1Y through 1K to the recording material P carried on and conveyed by a recording medium transfer belt. Further, the photosensitive drums 1Y through 1K can be belt-shaped photoreceptors, instead of drum-shaped photoreceptors. Further, any type of image forming apparatus can be used, regardless of whether the apparatus is a tandem-type or a single-drum type, and regardless of the electrostatic image forming method, the developing method, the transfer method and the fixing method adopted in the apparatus. Examples of such image forming apparatus include printers, various printing machines, copying machines, facsimiles and multifunction printers.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-060167, filed Mar. 23, 2015 which is hereby incorporated by reference herein in its entirety.

What is claimed is:

1. An image forming apparatus comprising:

a rotatable image bearing member;

a charging member disposed proximate or in contact with the image bearing member, the charging member charging the image bearing member by applying a voltage having superimposed an AC voltage and a DC voltage as a charging voltage during an image forming operation of forming an image on the image bearing member;

an image forming unit configured to form an image on the image bearing member being charged by the charging member;

a direct current detection unit configured to detect a direct current flowing from the charging member to the image bearing member when the charging voltage is applied to the charging member; and a control unit configured to selectively execute a first mode of setting a voltage having superimposed a first AC voltage and the predetermined DC voltage as the charging voltage during the image forming operation, the first AC voltage being set by applying a plurality of test AC voltages to the charging member during execution of the first mode, and a second mode of setting a voltage having superimposed a second AC voltage higher than the first AC voltage and the predetermined DC voltage as the charging voltage during the image forming operation, the second AC voltage being set by applying a plurality of test AC voltages to the charging member during execution of the second mode, the control unit applying the voltage having superimposed the first AC voltage and the predetermined DC voltage to the charging member, and detecting a direct current flowing from the charging member to the image bearing member via the direct current detection unit during execution of the first mode, and if an absolute value of the detected direct current is lower than a predetermined value, switching the first mode to the second mode and executing the second mode.

2. The image forming apparatus according to claim 1, wherein the control unit does not switch modes from the first mode to the second mode if the absolute value of the detected direct current is equal to or higher than the predetermined value in the first mode.

3. The image forming apparatus according to claim 1, wherein the predetermined value is an absolute value of DC component of a charging current flowing from the charging member to the image bearing member at a time of charging the image bearing member to a predetermined potential.

4. The image forming apparatus according to claim 1, further comprising:

an apparatus body; and a temperature detecting unit detecting a temperature within the apparatus body, wherein the control unit executes the first mode if a detected temperature detected by the temperature detecting unit is higher than a set temperature set in advance and executes the second mode without executing the first mode if the detected temperature detected by the temperature detecting unit is lower than the set temperature.

5. The image forming apparatus according to claim 1, wherein the control unit applies the voltage having superimposed the second AC voltage and the predetermined DC voltage to the charging member, detects the direct current flowing from the charging member to the image bearing member by the direct current detection unit during execution of the second mode, and stops setting the charging voltage if an absolute value of the detected direct current is lower than the predetermined value.

6. The image forming apparatus according to claim 1, wherein the control unit applies the voltage having superimposed the first AC voltage and the predetermined DC voltage to the charging member, detects the direct current flowing from the charging member to the image bearing member by the direct current detection unit, and if the absolute value of the detected direct current is equal to or higher than the predetermined value, sets the voltage having superimposed the first AC voltage and the predetermined DC voltage as the charging voltage during the image forming operation, during execution of the first mode.

7. The image forming apparatus according to claim 1, wherein the control unit applies the voltage having superimposed the second AC voltage and the predetermined DC voltage to the charging member, detects the direct current flowing from the charging member to the image bearing member by the direct current detection unit, and if an absolute value of the detected direct current is equal to or higher than the predetermined value, sets the voltage having superimposed the second AC voltage and the predetermined DC voltage as the charging voltage during the image forming operation, during execution of the second mode.

8. The image forming apparatus according to claim 1, wherein the control unit applies one or more test AC voltages within a non-discharge range and two or more different test AC voltages within a discharge range between the charging member and the image bearing member, measures alternating currents for each of the plurality of test AC voltages, and sets the first AC voltage based on a relationship between the applied test AC voltages and the measured alternating currents, during execution of the first mode, and the control unit applies one or more test AC voltages within the non-discharge range and two or more different test AC voltages within the discharging range between the charging member and the image bearing member, measures alternating currents for each of the plurality of test AC voltages, and sets the second AC voltage based on a relationship between applied test AC voltages and the measured alternating currents, during execution of the second mode.

9. The image forming apparatus according to claim 8, wherein the control unit calculates a nip current flowing through a nip portion of the image bearing member and the charging member based on a relationship between the applied test AC voltage and the measured alternating current in the non-discharge range, calculates a total current flowing through the image bearing member and the charging member during discharge based on the relationship between the applied test AC voltage and the measured alternating current in the discharge range, calculates the discharge current based on a difference between the total current and the nip current, and sets an AC voltage according to which the discharge current falls within a predetermined range as the first AC voltage, during execution of the first mode, and the control unit calculates the nip current flowing through the nip portion of the image bearing member and the charging member based on the relationship between the applied test AC voltage and the measured alternating current in the non-discharge range, calculates the total current flowing through the image bearing member and the charging member during discharge based on the relationship between the applied test AC voltage and the measured alternating current in the discharge range, calculates the discharge current based on a difference between the total current and the nip current, and sets an AC voltage according to which the discharge current falls within a predetermined range as the second AC voltage, during execution of the second mode.

10. The image forming apparatus according to claim 9, wherein the predetermined range of the discharge current is 30 through 100 μA.

11. The image forming apparatus according to claim 1, wherein the plurality of test AC voltages applied to the charging member during execution of the first mode and the plurality of test AC voltages applied to the charging member during execution of the second mode are different voltages.

12. The image forming apparatus according to claim 11, further comprising:

an apparatus body; and a temperature detecting unit detecting a temperature within the apparatus body, wherein the control unit executes the first mode when a detected temperature detected by the temperature detecting unit is higher than a set temperature set in advance, and the control unit executes the second mode without executing the first mode when the detected temperature detected by the temperature detecting unit is lower than the set temperature.

13. The image forming apparatus according to claim 1, wherein the control unit sets the predetermined value to a first predetermined value if an amount of use of the image bearing member is a first amount of use and sets the predetermined value to a second predetermined value that is higher than the first predetermined value if an amount of use of the image bearing member is a second amount of use that is higher than the first amount of use.

14. The image forming apparatus according to claim 13, wherein the image bearing member is a photoreceptor comprising a photosensitive layer, and the control unit calculates the amount of use of the image bearing member based on an accumulated operation time during which the image bearing member has been rotated, and an accumulated application time during which the charging voltage has been applied to the charging member.

15. The image forming apparatus according to claim 1, further comprising a destaticizing portion disposed upstream, in a direction of movement of the image bearing member, of the charging member, and destaticizing the image bearing member.

16. The image forming apparatus according to claim 1, wherein the greatest absolute value of the test AC voltage among the plurality of the absolute values of the AC voltages of the second mode is set to a value greater than the greatest absolute value of the test AC voltage among the plurality of the absolute values of the AC voltages of the first mode, and the smallest absolute value of the test AC voltage among the plurality of the absolute values of the AC voltages of the second mode is set to a value greater than the smallest absolute value of the test AC voltage among the plurality of the absolute values of the AC voltages of the first mode.

17. An image forming apparatus comprising:

a rotatable image bearing member;

a charging member disposed proximate or in contact with the image bearing member, the charging member charging the image bearing member by applying a voltage having superimposed an AC voltage and a DC voltage as a charging voltage during an image forming operation of forming an image on the image bearing member;

an image forming unit configured to form an image on the image bearing member being charged by the charging member;

a direct current detection unit configured to detect a direct current flowing from the charging member to the image bearing member when the charging voltage is applied to the charging member; and a control unit configured to selectively execute a first mode of setting a voltage having superimposed a first AC voltage and the predetermined DC voltage as the charging voltage during the image forming operation, and a second mode of setting a voltage having superimposed a second AC voltage higher than the first AC voltage and the predetermined DC voltage as the charging voltage during the image forming operation, wherein the control unit applies the voltage having superimposed the first AC voltage and the predetermined DC voltage to the charging member, and detects a direct current flowing from the charging member to the image bearing member by the direct current detection unit during execution of the first mode, and if an absolute value of the detected direct current is lower than a predetermined value, switches the first mode to the second mode and executes the second mode, the control unit applies one or more test AC voltages within a non-discharge range between the charging member and the image bearing member and measures an alternating current, calculates a nip current flowing through a nip portion of the image bearing member and the charging member based on a relationship between the applied test AC voltage and the measured alternating current in the non-discharge range, applies two or more different test AC voltages within a discharge range between the charging member and the image bearing member, measures alternating currents for each of the plurality of test AC voltages, calculates a total current flowing through the image bearing member and the charging member during discharge based on the relationship between the applied test AC voltage and the measured alternating current in the discharge range, calculates a discharge current based on a difference between the total current and the nip current, and sets an AC voltage according to which the discharge current falls within a predetermined range as the first AC voltage, during execution of the first mode, and the control unit applies one or more test AC voltages within the non-discharge range between the charging member and the image bearing member and measures an alternating current, calculates the nip current flowing through the nip portion of the image bearing member and the charging member based on the relationship between the applied test AC voltage and the measured alternating current in the non-discharge range and applies two or more different test AC voltages within the discharging range between the charging member and the image bearing member, measures alternating currents for each of the plurality of test AC voltages, calculates the total current flowing through the image bearing member and the charging member during discharge based on the relationship between the applied test AC voltage and the measured alternating current in the discharge range, calculates the discharge current based on a difference between the total current and the nip current, and sets an AC voltage according to which the discharge current falls within a predetermined range as the second AC voltage, during execution of the second mode.

* * * * *